United States Patent [19]

Lord

[11] 4,227,520

[45] Oct. 14, 1980

[54] SAFETY HELMET FOR MINERS

[75] Inventor: Ronald D. Lord, Toronto, Canada

[73] Assignee: Canadian Patents & Development Ltd., Ottawa, Canada

[21] Appl. No.: 1,423

[22] Filed: Jan. 8, 1979

[30] Foreign Application Priority Data

Feb. 10, 1978 [CA] Canada ..... 296,945

[51] Int. Cl.[3] ..... A62B 18/04

[52] U.S. Cl. ..... 128/201.24; 128/201.25; 2/171.3; 2/6

[58] Field of Search ..... 128/142.7, 142.5, 142.6, 128/145 R, 200.28, 201.22, 201.24; 2/2.1 A, 171.3, 8, 6, 436

[56] References Cited

U.S. PATENT DOCUMENTS

| | | | |
|---|---|---|---|
| 3,258,010 | 6/1966 | Austin et al. | 128/142.7 |
| 3,293,659 | 12/1966 | Shepard | 128/142.7 X |
| 3,310,811 | 3/1967 | Iacono, Jr. | 128/142.5 X |
| 3,413,972 | 12/1968 | Depping | 128/142.7 |
| 3,649,964 | 3/1972 | Schoelz | 128/142.7 X |
| 3,657,740 | 4/1972 | Cialone | 128/142.7 X |
| 3,910,269 | 10/1975 | Ansite et al. | 128/142.7 X |
| 3,963,021 | 6/1976 | Bancroft | 128/142.7 X |

FOREIGN PATENT DOCUMENTS 693175 8/1964 Canada .

*Primary Examiner*—Henry J. Recla

[57] ABSTRACT

A miner's safety helmet having a lamp mounted on the front thereof comprising inner and outer shells made of tough, hard plastic material having a generally hemispheric shape to conform with the upper part of the wearer's head, the shells being spaced apart, and closed around the rims thereof, to form an enclosed space therebetween, a slot-like opening at the front part of the rim of the helmet into the enclosed space, a visor of tranparent plastic material rectractably and telescopically mounted in the slot and having a doubly curved shape to conform with the shape of the enclosed space such that when the visor is in a fully retracted position it lies almost completely in the enclosed space and when in fully extended position it extends over the face of the wearer, an air supply connection at the rear of the helmet adapted for connection to a source of clean filtered air, switch means mounted in the helmet in the enclosed space in relation to the visor configuration, and electrical leads from the switch to the air source, such that when the visor is in the fully extended position the switch is operative to turn on the air source to provide a flow of air down over the wearer's face inside the visor and when the visor is in a partially or fully retracted position the switch is operative to turn off the air supply.

2 Claims, 8 Drawing Figures

SAFETY HELMET FOR MINERS

This invention relates to a safety helmet for miners and especially a helmet incorporating a retractable visor and apparatus for providing a flow of filtered air over the face of the wearer.

The use of safety helmets (hard hats) in hazardous areas in industry and mines is widespread and the concept of providing an air curtain around the face of the wearer to protect against dust and aerosols is known. U.S. Pat. No. 3,822,698 issued July 9, 1974 to R. E. Guy describes a powered air-purifying respirator helmet equipped with a built-in powered air blower and air filtering system which removes contaminants from the surrounding air and continuously delivers the purified air under positive pressure to an area between the wearers face and a fitted transparent face shield supported from the helmet visor. U.S. Pat. No. 3,881,478 issued May 6, 1975 to T. E. Rosendahl and W. J. Krisko describes an industrial helmet with means for providing a high velocity air curtain to protect the wearer against inhalation of air-borne particulate matter. An anti-dust helmet designed to protect the wearer in dusty environments is described in the Mining Journal, Feb. 20, 1976, pg. 141. In this helmet, contaminated air is drawn in via filters and a fan and clean, dust free air is channelled to the wearer's mouth between his face and a transparent visor.

It is an object of the present invention to provide a safety helmet for underground mine workers of the type which includes a cap lamp and which incorporates protection for the head , eyes, face and respiratory system.

This and other objects of the invention are achieved by a miner's safety helmet having a lamp mounted on the front thereof comprising inner and outer shells made of tough, hard plastic material having a generally hemispheric shape to conform with the upper part of the wearer's head, the shells being spaced apart, and closed around the rims thereof, to form an enclosed space therebetween, a slot-like opening at the front part of the rim of the hekmet into the enclosed space, a visor of transparent plastic material rectractably and telescopically mounted in the slot and having a doubly curved shape to conform with the shape of the enclosed space such that when the visor is in a fully retracted position it lies almost completely in the enclosed space and when in fully extended position it extends over the face of the wearer, an air supply connection at the rear of the helmet adapted for connection to a source of clean filtered air, switch means mounted in the helmet in the enclosed space in relation to the visor configuration, and electrical leads from the switch to the air source, such that when the visor is in the fully extended position the switch is operative to turn on the air source to provide a flow of air down over the wearer's face inside the visor and when the visor is in a partially or fully retracted position the switch is operative to turn off the air supply.

In drawings which illustrate an embodiment of the invention,

Figure 1:
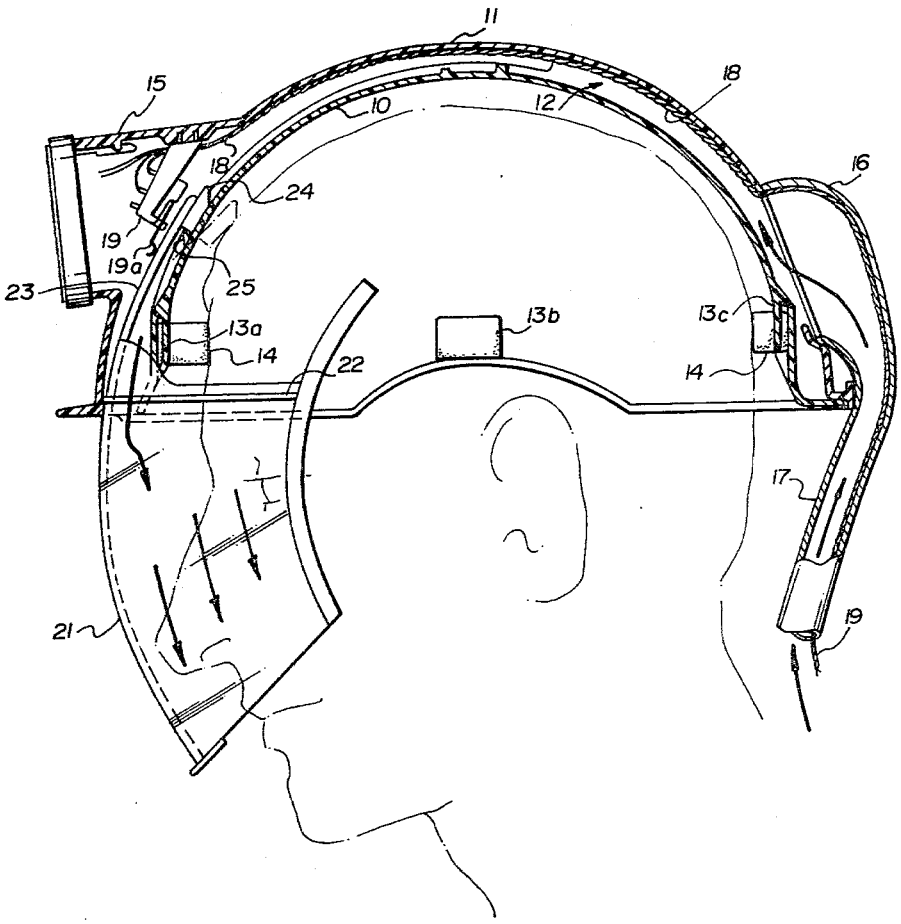
FIG. 1 is a cross-section of the helmet with visor fully down.

Referring to FIG. 1, the helmet consists of an inner shell 10 and outer shell 11 having generally spherical contours to encompass the upper part of the wearer's head. These shells can be made of the standard hard plastic materials e.g. polycarbonate plastics and are spaced apart a fixed predetermined distance defining an inner space 12 between shells. The inner shell incorporates facilities 13*a*, 13*b*, 13*c* for the attachment of straps or webbing 14 for the wearer's head and the outer shell has integral with it a mounting structure 15 on which can be mounted a miner's lamp. At the rear of the helmet is an airtight connector fitting 16 and an air hose 17 leading to an air pump and air filter (not shown) mounted at the waist of the wearer. This provides a flow of clean filtered air under pressure into cavity 12. Electrical leads 18 from a battery pack (not shown) also worn on the wearer's body pass through tube 17 and cavity 12 to microswitch 19 for control purposes to be described more fully below and for power to the lamp.

Mounted inside the concentric helmet shells is a transparent visor 21 made of plastic material, preferably having a hardened surface. The visor has a doubly curved shape to allow fitting and retracting movement between the helmet shells 10 and 11. In FIG. 1 the visor is fully down covering the eyes, nose, and mouth of the wearer. Microswitch 19 having contactor arm 19*a* sliding on the surface of the visor is in the closed position which switches the air supply on at the pump. Air from cavity 12 flows from between the two shells, under the visor and over the face of the wearer. This flow is not an air curtain but a gentle washing stream of clean air.

Figure 2:
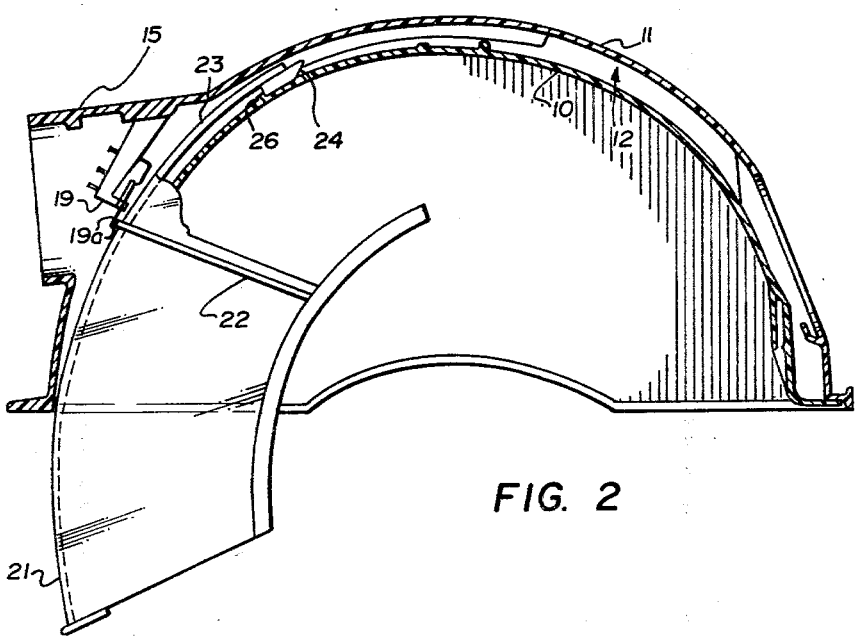
FIG. 2 is a cross-section of the helmet with visor partially retracted.

The visor slides in a track formed between the inner and outer shells of the helmet and has an upper retaining flange 22 such that when it is in the fully extended position as shown in FIG. 1 this flange fits tightly against the inside surface of the outer shell preventing passage of air to the outside at that line. Extending upward from the visor is a member 23 with a runner 24 that slides along the surface of inner shell 10. In the fully extended position, the runner comes against stop 25. FIG. 2 shows the visor partially retracted. Runner 24 has passed and taken up a position beyond detent 26 and flange 22 has passed microswitch arm 19*a* operating microswitch 19 to cutt off the air supply. In this position, the visor protects the wearer's eyes but no cleaning air flow is required.

Figure 3:
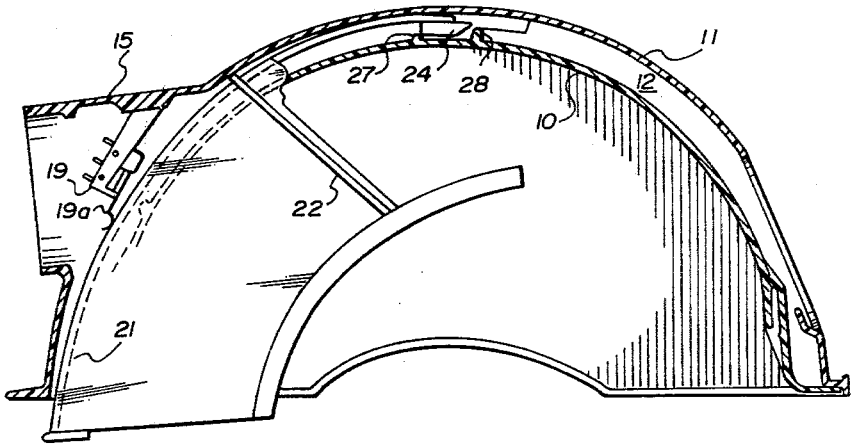
FIG. 3 is a cross-section of the helmet with visor filly retracted.

FIG. 3 shows the visor fully retracted with runner 24 positioned between detent 27 and stop 28. In this position the air flow and the visor are not required.

Figure 4:
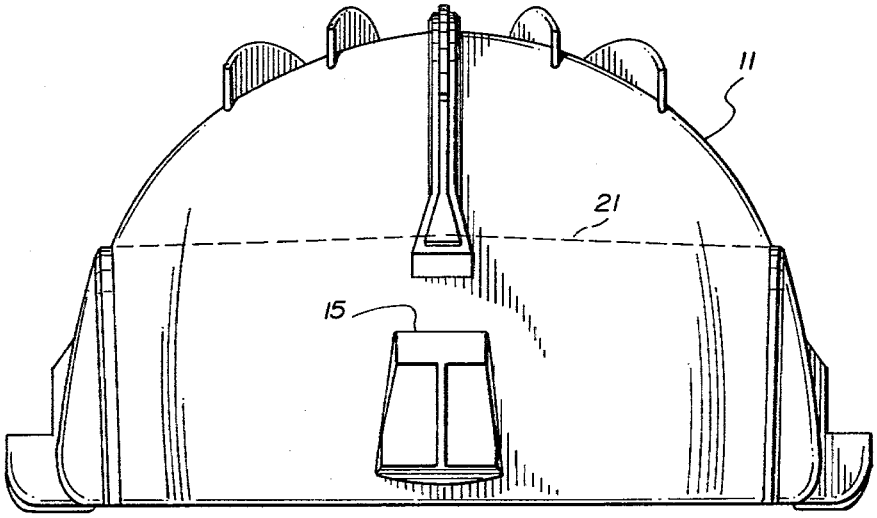
FIG. 4 is a front view of the helmet.
Figure 5:
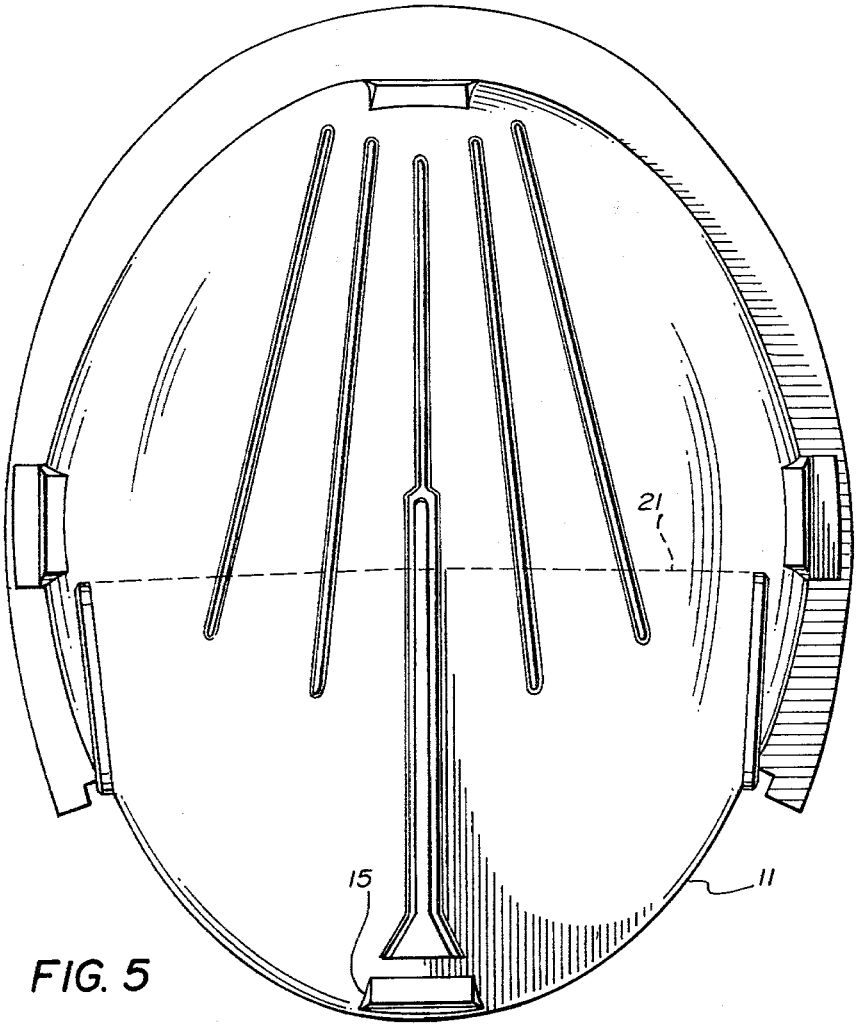
FIG. 5 is a top plan view of the helmet.
Figure 8:
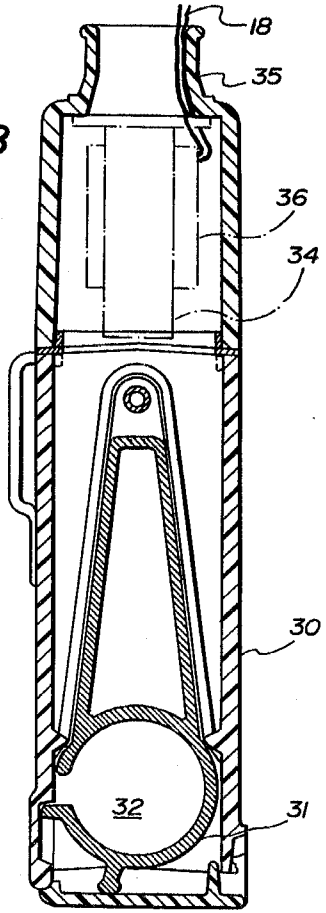
FIGS. 6, 7 and 8 are views of of a filter pack and blower for the helmet.
Figure 7:
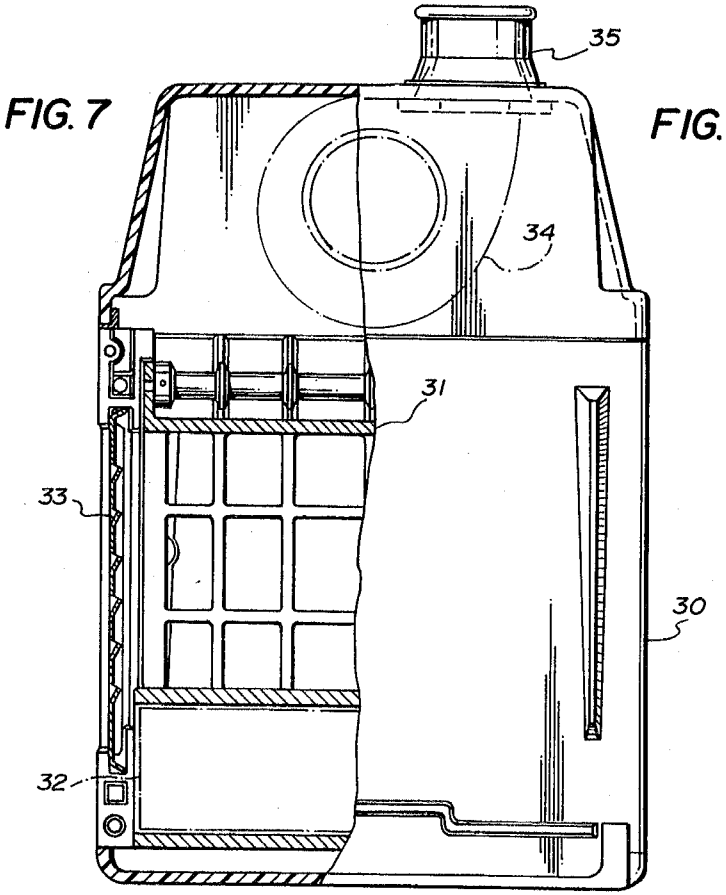
Figure 6:
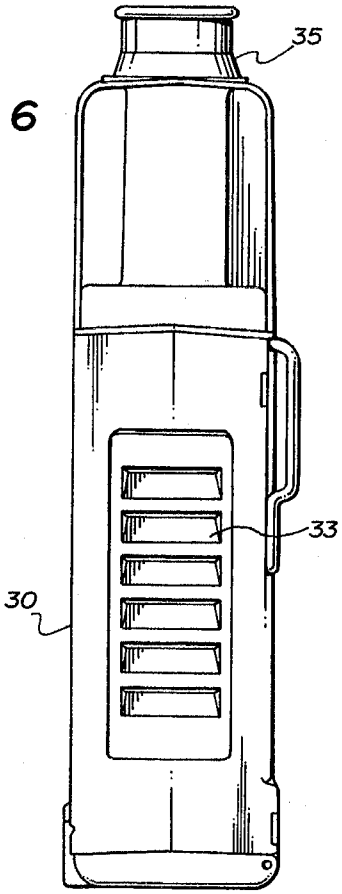

FIG. 4 is a front view of the helmet showing the outer shell 11, lamp mounting structure 15. The visor 21 shown by dotted lines is in the fully up position. FIG. 5 is a top plan view again showing the visor in dotted lines and in the fully up position. FIG. 6 is an end view and FIGS. 7 and 8 are crooss-sections of a filter and air pump for the helmet. This piece of the apparatus would be carried by the wearer attached to his belt and his waist such that the sound of the air blower would be away from his ears. Referring to the three figures, the pack is carried in a suitable plastic container 30 and contains a replaceable filter cassette 31 holding filter paper 32. Air from outside passes through louvres 33, through the filter paper, through the blower 34, and out pipe 35 which in operation would be connected to tube 17 leading to the helmet (see FIG. 1). The blower is driven by a small electric motor 36 operated from batteries that may be located in the container or externally in a separate battery pack. The motor is switched on and off from the microswitch 19 (FIG. 1) in leads 18.

I claim:

1. A miner's safety helmet comprising:

(a) inner and outer shells made of tough, hard impact resistant material having a generally hemispheric shape to conform to upper part of the wearer's head, the shells being spaced apart, closed around the rims thereof to form an enclosed space therebetween, and shaped around the rims such that when positioned on the wearer's head, the wearer's ears are left uncovered, (b) a slot like opening at the front part of the rim of the helmet into the enclosed space, (c) a visor of transparent plastic material retractably and telescopically mounted in the slot and having a doubly curved shape to conform with the shape of the enclosed space such that when the visor is in a fully retracted position it lies almost completely in the enclosed space and when in fully extended position it extends over the face of the wearer, (d) a source of clean filtered air, (e) an air supply connection at the rear of the helmet connected to said source of clean filtered air, said air supply connection connected to the enclosed space between inner and outer shells, (f) switch means mounted in the helmet in the enclosed space and operatively disposed in relation to the visor configuration, and (g) means connected between the switch means and the air source, such that when the visor is in an extended position the switch is operative to turn on the air source to provide a flow of air down over the wearer's face inside the visor and when the visor is in partially or fully retracted position the switch is operative to turn off the air supply.

2. A miner's safety helmet as in claim 1 wherein said air source comprises a container adapted to be carried on the wearer's apparel at a position away from his head for taking in air from the surrounding atmosphere, said container having an inlet and an outlet, an air filter mounted in said inlet, an air blower mounted in said container for passing air from said inlet to said outlet, said means connected between said switch means and said air source comprises electrical leads from said switch means to said air blower, and conduit means connecting said outlet to said air supply connection whereby filtered air is passed under pressure to the space between the inner and outer shells of the helmet via said conduit means.

* * * * *